US010203642B2

(12) United States Patent
Shibata et al.

(10) Patent No.: US 10,203,642 B2
(45) Date of Patent: Feb. 12, 2019

(54) IMAGE FORMING APPARATUS AND A RECORDING MEDIUM FOR DETERMINING IMAGE DEFECTS BASED ON DEVELOPMENT CURRENT

(71) Applicant: Konica Minolta, Inc., Chiyoda-ku, Tokyo (JP)

(72) Inventors: Hiroki Shibata, Tokyo (JP); Wataru Watanabe, Tokyo (JP); Keiki Katsumata, Tokyo (JP); Natsuko Kawai, Tokyo (JP); Kazuhiro Saito, Aichi (JP); Hiroshi Morimoto, Tokyo (JP)

(73) Assignee: KONICA MINOLTA, INC., Chiyoda-Ku, Tokyo (JP)

( * ) Notice: Subject to any disclaimer, the term of this patent is extended or adjusted under 35 U.S.C. 154(b) by 0 days.

(21) Appl. No.: 15/724,761

(22) Filed: Oct. 4, 2017

(65) Prior Publication Data

US 2018/0107145 A1 Apr. 19, 2018

(30) Foreign Application Priority Data

Oct. 13, 2016 (JP) ..... 2016-201863

(51) Int. Cl.
*G03G 15/00* (2006.01)
*G03G 15/06* (2006.01)

(52) U.S. Cl.
CPC ..... *G03G 15/5062* (2013.01); *G03G 15/065* (2013.01); *G03G 15/5037* (2013.01); *G03G 15/55* (2013.01)

(58) Field of Classification Search
CPC ..... G03G 15/5062; G03G 15/065; G03G 15/5037; G03G 15/55
USPC ..... 399/15
See application file for complete search history.

(56) References Cited

U.S. PATENT DOCUMENTS

2008/0267641 A1* 10/2008 Konishi ..... G03G 15/0806 399/27

FOREIGN PATENT DOCUMENTS

| | | | | |
|---|---|---|---|---|
| JP | 2000-131934 | A | | 5/2000 |
| JP | 2001-318493 | A | | 11/2001 |
| JP | 2007147980 | A | * | 6/2007 |
| JP | 2015230367 | A | * | 12/2015 |
| JP | 2016-009933 | A | | 1/2016 |

* cited by examiner

*Primary Examiner* — Susan S Lee
(74) *Attorney, Agent, or Firm* — Buchanan Ingersoll & Rooney PC

(57) ABSTRACT

An image forming apparatus includes a development current detector that detects an actual measurement value of a development current, a development current calculator that calculates a provisional calculation value of a development current based on an image formation condition, and an image-defect determiner that determines whether or not an image defect occurs, based on the actual measurement value of the development current detected by the development current detector and the provisional calculation value of the development current calculated by the development current calculator.

20 Claims, 7 Drawing Sheets

IMAGE FORMING APPARATUS AND A RECORDING MEDIUM FOR DETERMINING IMAGE DEFECTS BASED ON DEVELOPMENT CURRENT

CROSS REFERENCE TO RELATED APPLICATIONS

Japanese Patent Application No. 2016-201863 filed on Oct. 13, 2016, including description, claims, drawings, and abstract the entire disclosure is incorporated herein by reference in its entirety.

BACKGROUND

Technological Field

The present invention relates to an image forming apparatus and a recording medium.

Description of Related Art

In general, an electrophotographic image forming apparatus (such as a printer, a copy machine, and a fax machine) is configured to irradiate (expose) a charged photoconductor drum (image bearing member) with (to) laser light based on image data to form an electrostatic latent image on the surface of the photoconductor. The electrostatic latent image is then visualized by supplying toner from a developing device to the photoconductor drum on which the electrostatic latent image is formed, whereby a toner image is formed. Further, the toner image is directly or indirectly transferred to a sheet, and then heat and pressure are applied to the sheet at a fixing nip to form a toner image on the sheet.

In the image forming apparatus, image defects, such as flawed images, may occur in a sheet on which an image is formed, and a configuration of the image forming apparatus in which an image reading device for detecting such image defects is provided has been known. For example, in a configuration disclosed in Japanese Patent Application Laid-Open No. 2016-9933, an image reading device reads an image output onto a sheet to determine whether or not an image defect has occurred.

SUMMARY

The configuration disclosed in Japanese Patent Application Laid-Open No. 2016-9933, however, includes a problem in that a machinery installation area increases since a post-processing apparatus is required for the image reading device to be provided therein. In addition, because whether or not an image defect has occurred is determined based on an image output onto a sheet, there is also a problem in that it is difficult to identify a cause of occurrence of the image defect in a case where image defects originating from different image forming processes are mixed in the image defect on the sheet, and it is therefore difficult to provide accurate feedback to each of the image forming processes.

An object of the present invention is to provide an image forming apparatus and recording medium in which it is possible to easily divide causes of image defects without increasing a machinery installation area.

An image forming apparatus in which one aspect of the present invention is reflected in an attempt to at least partly achieve the above-mentioned object includes: a developer bearing member that bears developer; an image bearing member to which toner is supplied from the developer bearing member; a development current detector that detects an actual measurement value of a development current which flows between the image bearing member and the developer bearing member; a hardware processor that calculates a provisional calculation value of a development current based on an image formation condition, and that determines whether or not an image defect occurs, based on the actual measurement value of the development current detected by the development current detector and on the provisional calculation value of the calculated development current.

A recording medium in which one aspect of the present invention is reflected in an attempt to at least partly achieve the above-mentioned object is a non-transitory recording medium storing therein a computer-readable program for an image forming apparatus including a developer bearing member that bears developer and an image bearing member to which toner is supplied from the developer bearing member. In the recording medium, the program causes a computer in the image forming apparatus to carry out: development-current detection processing of detecting an actual measurement value of a development current which flows between the image bearing member and the developer bearing member; development-current calculation processing of calculating a provisional calculation value of a development current based on an image formation condition; and image-defect determination processing of determining whether or not an image defect occurs, based on the actual measurement value of the development current detected by the development-current detection processing and the provisional calculation value of the development current calculated by the development-current calculation processing.

BRIEF DESCRIPTION OF DRAWINGS

The advantages and features provided by one or more embodiments of the invention will become more fully understood from the detailed description given hereinbelow and the appended drawings which are given by way of illustration only, and thus are not intended as a definition of the limits of the present invention.

DETAILED DESCRIPTION OF EMBODIMENTS

Hereinafter, one or more embodiments of the present invention will be described with reference to the drawings. However, the scope of the invention is not limited to the disclosed embodiments.

Figure 1:
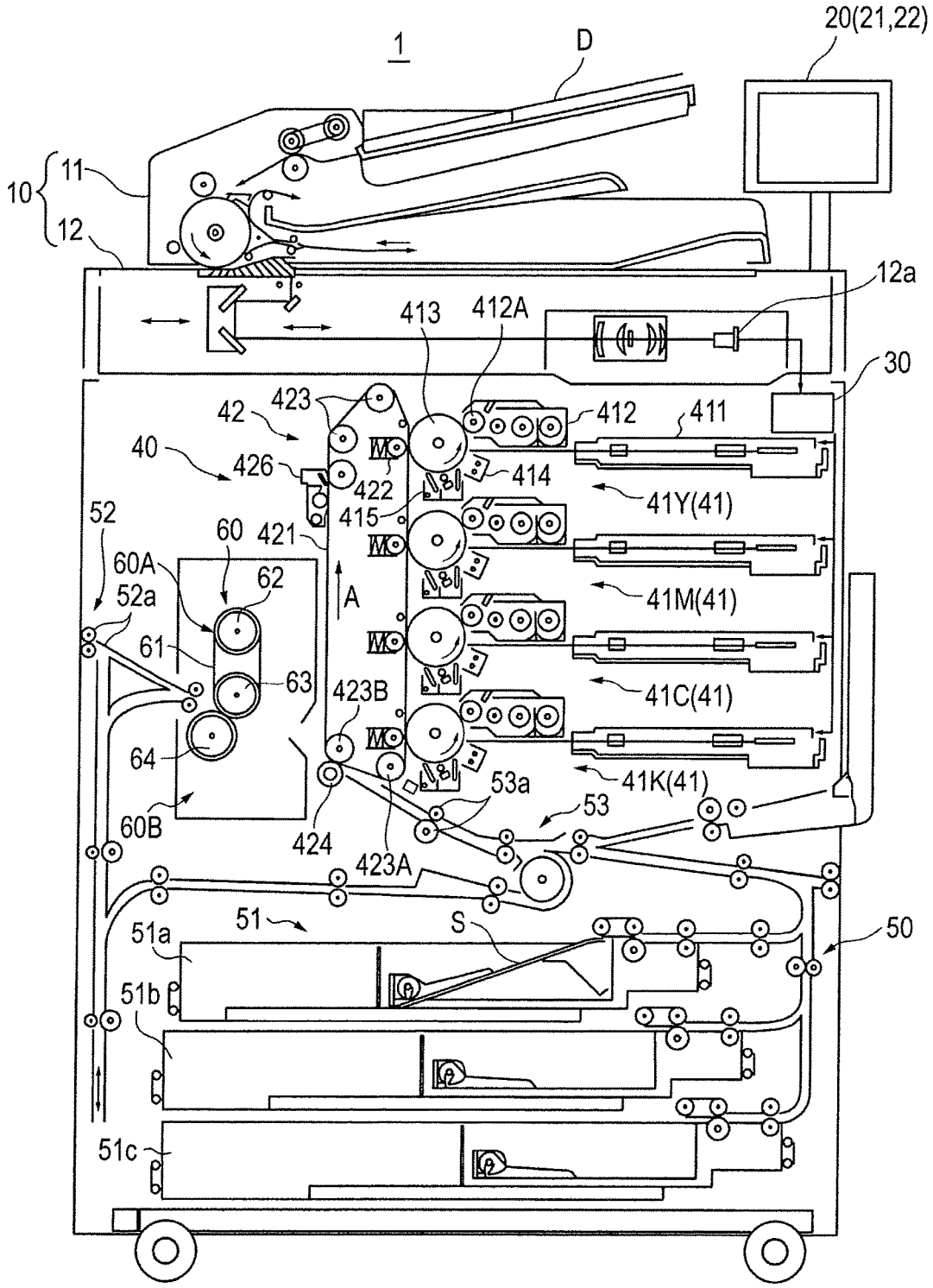
FIG. 1 schematically illustrates an entire configuration of an image forming apparatus according to an embodiment of the present invention.
Figure 2:
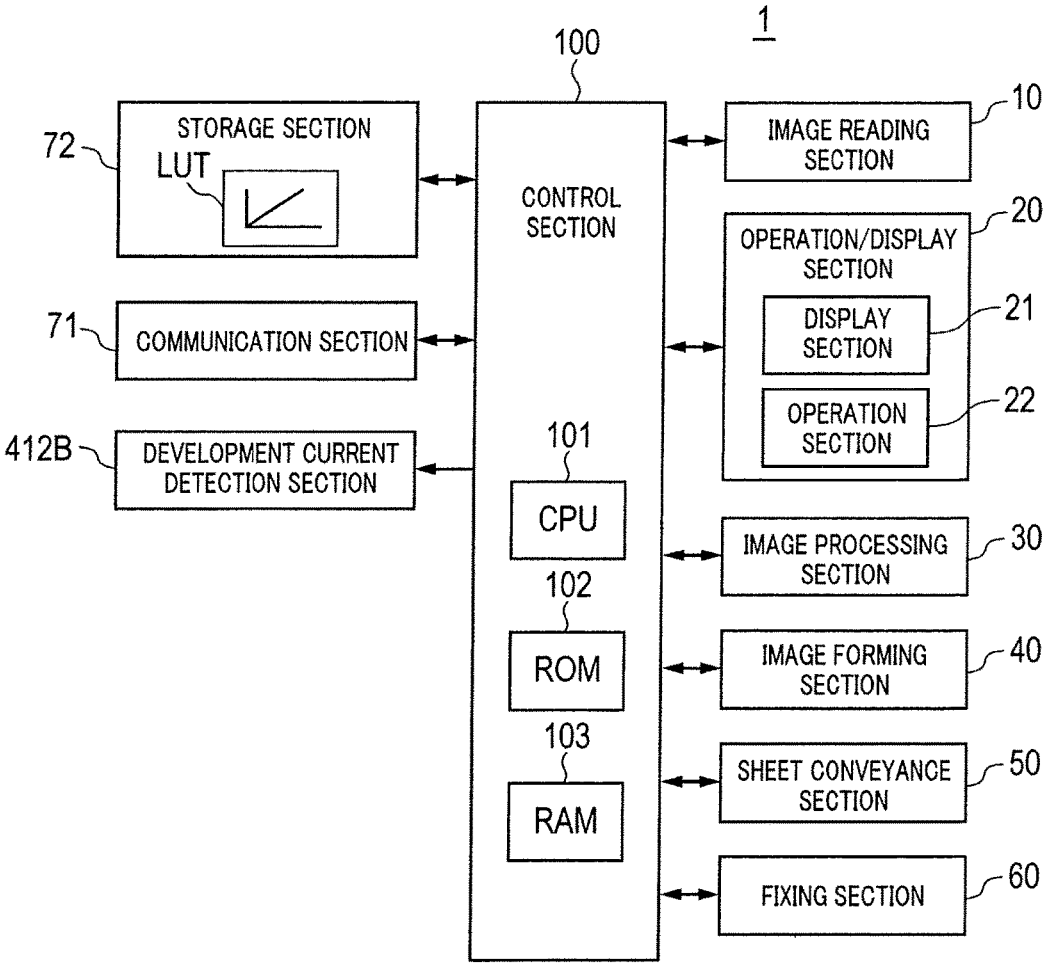
FIG. 2 illustrates a principal part of a control system of the image forming apparatus according to the embodiment of the present invention.

Hereinafter, an embodiment of the invention is described in detail based on the drawings. FIG. 1 schematically illustrates an entire configuration of image forming apparatus 1 according to the embodiment of the present invention. FIG. 2 illustrates a principal part of a control system of image forming apparatus 1 according to the embodiment of the present invention.

Image forming apparatus 1 illustrated in FIGS. 1 and 2 is a color image forming apparatus of an intermediate transfer system using electrophotographic process technology. That is, image forming apparatus 1 transfers (primary-transfers) toner images of yellow (Y), magenta (M), cyan (C), and black (K) formed on photoconductor drums 413 to intermediate transfer belt 421, and superimposes the toner images of the four colors on one another on intermediate transfer belt 421. Then, image forming apparatus 1 secondary-transfers the resultant image to sheet S, thereby forming an image.

A longitudinal tandem system is adopted for image forming apparatus 1. In the longitudinal tandem system, respective photoconductor drums 413 corresponding to the four colors of YMCK are placed in series in the travelling direction (vertical direction) of intermediate transfer belt 421, and the toner images of the four colors are sequentially transferred to intermediate transfer belt 421 in one cycle.

Image forming apparatus 1 includes image reading section 10, operation/display section 20, image processing section 30, image forming section 40, sheet conveyance section 50, fixing section 60, and control section 100.

Control section 100 includes central processing unit (CPU) 101, read only memory (ROM) 102, random access memory (RAM) 103 and the like. CPU 101 reads a program suited to processing contents out of ROM 102, loads the program into RAM 103, and integrally controls an operation of each block of image forming apparatus 1 in cooperation with the loaded program. At this time, CPU 101 refers to various kinds of data stored in storage section 72. Storage section 72 is composed of, for example, a non-volatile semiconductor memory (so-called flash memory) and/or a hard disk drive.

Control section 100 transmits and receives various data to and from an external apparatus (for example, a personal computer) connected to a communication network such as a local area network (LAN) or a wide area network (WAN), through communication section 71. Control section 100 receives, for example, image data (input image data) transmitted from the external apparatus, and performs control to form an image on sheet S on the basis of the image data. Communication section 71 is composed of, for example, a communication control card such as a LAN card.

Image reading section 10 includes auto document feeder (ADF) 11, document image scanning device 12 (scanner), and the like.

Auto document feeder 11 conveys, with a conveyance mechanism, document D placed on a document tray, to send out document D to document image scanner 12. Auto document feeder 11 makes it possible to successively read at once images (even both sides thereof) of a large number of documents D placed on the document tray.

Document image scanner 12 optically scans a document conveyed from auto document feeder 11 onto a contact glass or a document placed on the contact glass, and images reflected light from the document on a light receiving surface of charge coupled device (CCD) sensor 12*a* to read the document image. Image reading section 10 generates input image data based on results read by document image scanner 12. The input image data undergo predetermined image processing in image processing section 30.

Operation/display section 20 includes, for example, a liquid crystal display (LCD) provided with a touch panel, and functions as display section 21 and operation section 22. Display section 21 displays various operation screens, image conditions, operating statuses of each function, information about the inside of image forming apparatus 1, and/or the like in accordance with display control signals input from control section 100. Operation section 22 equipped with various operation keys, such as a numeric keypad and a start key, receives various input operations by users and outputs operation signals to control section 100.

Image processing section 30 includes a circuit and/or the like that performs digital image processing of input image data in accordance with default settings or user settings. For example, image processing section 30 performs tone correction based on tone correction data (tone correction table) under the control of control section 100. Moreover, image processing section 30 performs various correction processing, such as color correction or shading correction, in addition to tone correction, and, compression processing, and the like of input image data. Image forming section 40 is controlled on the basis of the image data that has been subjected to these processes.

Image forming section 40 includes: image forming units 41Y, 41M, 41C, and 41K that form images of colored toners of a Y component, an M component, a C component, and a K component on the basis of the input image data; intermediate transfer unit 42; and the like.

Image forming units 41Y, 41M, 41C, and 41K for the Y component, the M component, the C component, and the K component have similar configurations. For convenience in illustration and description, common elements are denoted by the same reference signs and such reference signs are accompanied by Y, M, C, or K when they are to be distinguished. In FIG. 1, reference signs are given to only the elements of image forming unit 41Y for the Y component, and reference signs are omitted for the elements of other image forming units 41M, 41C, and 41K.

Image forming unit 41 includes exposing device 411, developing device 412, photoconductor drum 413, charging device 414, drum cleaning device 415 and the like. Photoconductor drum 413 corresponds to the "image bearing member" of the present invention.

Photoconductor drum 413 is a negative-charging type organic photoconductor (OPC) formed by sequentially laminating an undercoat layer (UCL), a charge generation layer (CGL), and charge transport layer (CTL) on a peripheral surface of a conductive cylindrical body made of aluminum (aluminum pipe as a raw material), for example. The diameter of photoconductor drum 413 in the present embodiment is 60 mm, and the linear velocity of photoconductor drum 413 is 314 mm/s.

Charging device 414 evenly and negatively charge the surface of photoconductor drum 413 having photoconductivity by generating corona discharge.

Exposing device 411 is composed of, for example, a semiconductor laser, and configured to irradiate photoconductor drum 413 with laser light corresponding to the image of each color component. Positive charges are generated in the charge generation layer of photoconductor drum 413 and transported to the surface of the charge transport layer, whereby the surface charges (negative charges) of photoconductor drum 413 are neutralized. Electrostatic latent images of respective color components are formed on the surface of photoconductor drum 413 due to potential differences from the surroundings.

Developing device 412 is a developing device of a two-component counter-rotation type, and attaches toners of respective color components to the surface of photoconductor drums 413, and visualizes the electrostatic latent image to form a toner image. Developing sleeve 412A (which corresponds to the "developer bearing member" of the present invention) held by developing device 412 bears developer while rotating, and supplies the toner contained in the developer to photoconductor drum 413, to form a toner image on the surface of photoconductor drum 413.

In the meantime, the amounts of toner adhering to photoconductor drum 413 in the case of a solid image in the embodiment are 4.3, 4.3, 4.0, and 4.5 g/m$^2$, respectively for the Y, M, C, and K components. In addition, the charge amount of the toner in the present embodiment is 40 μC/g. The nip width between developing sleeve 412A and photoconductor drum 413 in the present embodiment is 3 mm.

Development current detection section 412B detects an actual measurement value of a development current which flows between photoconductor drum 413 and developing sleeve 412A. Development current detection section 412B detects the actual measurement value of the development current generated by a developing bias applied to developing sleeve 412A by a developing-bias application section which is not illustrated in the figures, and development current detection section 412B then outputs the actual measurement value to control section 100. The detection variation of the development current in the present embodiment is 0.2 μA.

Drum cleaning device 415 includes a drum cleaning blade that is brought into sliding contact with the surface of photoconductor drum 413, and removes transfer residual toner that remains on the surface of photoconductor drum 413 after the primary transfer.

Intermediate transfer unit 42 includes intermediate transfer belt 421, primary transfer roller 422, a plurality of support rollers 423, secondary transfer roller 424, belt cleaning device 426, and the like.

Intermediate transfer belt 421 is composed of an endless belt, and is stretched around the plurality of support rollers 423 in a loop form. At least one of the plurality of support rollers 423 is composed of a driving roller, and the others are each composed of a driven roller. Intermediate transfer belt 421 travels in direction A at a constant speed by rotation of a driving roller. Intermediate transfer belt 421 is a conductive and elastic belt and driven into rotation with a control signal from control section 100.

Primary transfer rollers 422 are disposed on the inner peripheral surface side of intermediate transfer belt 421 to face photoconductor drums 413 of respective color components. Primary transfer rollers 422 are brought into pressure contact with photoconductor drums 413 with intermediate transfer belt 421 therebetween, whereby a primary transfer nip for transferring a toner image from photoconductor drums 413 to intermediate transfer belt 421 is formed.

Secondary transfer roller 424 is disposed to face backup roller 423B disposed downstream of driving roller 423A in the belt travelling direction at a position on the outer peripheral surface side of intermediate transfer belt 421. Secondary transfer roller 424 is brought into pressure contact with backup roller 423B with intermediate transfer belt 421 therebetween, whereby a secondary transfer nip for transferring a toner image from intermediate transfer belt 421 to sheet S is formed.

Belt cleaning device 426 removes transfer residual toner which remains on the surface of intermediate transfer belt 421 after a secondary transfer.

When intermediate transfer belt 421 passes through the primary transfer nip, the toner images on photoconductor drums 413 are sequentially primary-transferred to intermediate transfer belt 421. To be more specific, a primary transfer bias is applied to primary transfer rollers 422, and an electric charge of the polarity opposite to the polarity of the toner is applied to the rear surface side, that is, a side of intermediate transfer belt 421 that makes contact with primary transfer rollers 422 whereby the toner image is electrostatically transferred to intermediate transfer belt 421.

Thereafter, when sheet S passes through the secondary transfer nip, the toner image on intermediate transfer belt 421 is secondary-transferred to sheet S. To be more specific, a secondary transfer bias is applied to backup roller 423B, and an electric charge of the polarity identical to the polarity of the toner is applied to the front surface side, that is, a side of sheet S that makes contact with intermediate transfer belt 421 whereby the toner image is electrostatically transferred to sheet S.

Fixing section 60 includes upper fixing section 60A having a fixing-surface-side member disposed on a side of the surface of sheet S on which a toner image is formed, that is, on a fixing surface side of sheet S, lower fixing section 60B having a rear-surface-side supporting member disposed on a side of the surface of sheet S opposite to the fixing surface, that is, on the rear surface side of sheet S, and the like. The rear-surface-side supporting member is brought into pressure contact with the fixing-surface-side member, whereby a fixing nip for conveying sheet S in a tightly sandwiching manner is formed.

At the fixing nip, fixing section 60 applies heat and pressure to sheet S on which a toner image has been secondary-transferred and which has been conveyed to the fixing nip, so as to fix the toner image on sheet S.

Upper fixing section 60A includes endless fixing belt 61, heating roller 62 and fixing roller 63, which serve as the fixing-surface-side member. Fixing belt 61 is stretched around heating roller 62 and fixing roller 63.

Lower fixing section 60B includes pressure roller 64 that is the rear-surface-side supporting member. Together with fixing belt 61, pressure roller 64 forms a fixing nip for conveying sheet S in a sandwiching manner.

Sheet conveyance section 50 includes sheet feeder 51, sheet ejection section 52, conveyance path section 53 and the like. Three sheet feeding tray units 51*a* to 51*c*, which constitute sheet feeding section 51, store sheets S classified based on basis weight, size, or the like (standard paper, special paper) in accordance with predetermined types.

Conveying path section 53 includes a plurality of conveying roller pairs, such as registration roller pairs 53*a*. Sheets S stored in sheet feeding tray units 51*a* to 51*c* are sent out one by one from the top one and conveyed to image forming section 40 through conveying path section 53. At this time, the registration roller section in which registration roller pairs 53*a* are arranged corrects skew of sheet S fed thereto, and the conveyance timing is adjusted. Then, in image forming section 40, the toner image on intermediate transfer belt 421 is secondary-transferred to one side of sheet S at one time, and a fixing process is performed in fixing section 60. Sheet S on which an image has been formed is ejected out of the image forming apparatus by sheet ejection section 52 including sheet ejection rollers 52*a*.

In the meantime, in image forming apparatus 1, image defects, such as flawed images, may occur in sheet S on which an image has been formed. A configuration of image forming apparatus 1 in which an image reading device for detecting such image defects is provided has been known. With the configuration of the image forming apparatus in which the image reading device is provided, the image reading section reads an image output onto sheet S to determine whether or not an image defect has occurred.

In order to provide an image reading device, however, there has been a problem in that a machinery installation area increases since a post-processing apparatus including the image reading device is required. In addition, because whether or not an image defect has occurred is determined based on an image output onto sheet S, there has also been a problem in that it is difficult to identify a cause of occurrence of the image defect in a case where image defects originating from different image forming processing are mixed in the image defect on the sheet, and it is therefore difficult to provide accurate feedback to each of the image forming processing.

Examples of causes of image defects may include a cause originating from image formation processes preceding completion of development. The image formation processes preceding completion of development include a charging process in charging device 414, an exposing process in exposing device 411, and a developing process in developing device 412.

The image defect originating from the image formation processes preceding completion of development is likely to occur, for example, in the second image formation processing that is performed subsequently after the first image formation processing in which a large amount of toner is consumed.

For example, performing the second image formation processing in a condition where the amount of toner in developing device 412 is reduced because of a large amount of toner consumption in the first image formation processing causes an image defect that the toner density in the second image formation processing is lowered compared to a desired toner density.

In addition, although static electricity is removed from the surface of photoconductive drum 413 after image formation processing, a history of the first image formation processing may remain on photoconductive drum 413, and in this case, a charging state and an exposure state of photoconductive drum 413 differ from a desired charging state and desired exposure state, which causes an image defect that a toner density is different from a desired toner density.

In addition, at an end of an image along the sheet-passing direction, there is a boundary between a part where toner is not present and a part where toner is present. At such a boundary, toner electrostatically moves to the end in which a difference in toner density arises, and in this case, an image defect that an actual toner density is different from a desired toner density occurs.

As described above, such an image defect originating from the image formation processes preceding completion of development is caused due to a difference between a desired toner density and an actual toner density, and is thus considered to occur by a difference between a development current supposed based on image formation conditions and an actual development current.

In the present embodiment, control section 100 therefore performs control in which whether or not an image defect occurs is determined based on an actual measurement value of a development current detected by development current detection section 412B and a provisional calculation value of a development current based on image formation conditions. By determining whether or not an image defect has occurred in this way, it is made possible to accurately determine whether or not the image defect originates from the image formation processes preceding completion of development. Hereinafter, control in the present embodiment is described. Control section 100 corresponds to a "development current calculator" and an "image-defect determiner" of the present invention.

To begin with, calculation of a provisional calculation value of a development current based on image formation conditions is described.

Figure 3:
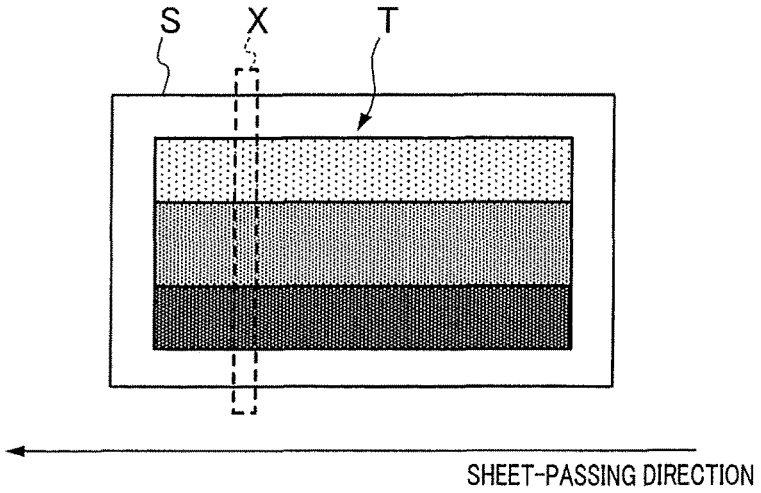
FIG. 3 is a view of a sheet on which an image has been formed, and illustrates a region of the sheet at a predetermined position along the sheet-passing direction, for which the toner adhesion amount is calculated.

As illustrated in FIG. 3, control section 100 calculates, from image formation conditions, a toner adhesion amount to photoconductor drum 413 for each portion along the main scanning direction (direction perpendicular to the sheet-passing direction) at each position in the sheet-passing direction. To be specific, in the case of sheet S as illustrated in FIG. 3, a toner adhesion amount is calculated for each portion along the sheet-passing direction that is equivalent to portion X with a width corresponding to the width of one-dot line.

Figure 4:
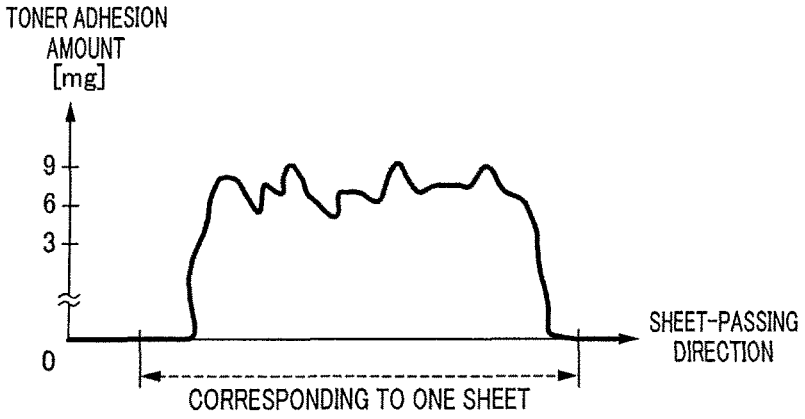
FIG. 4 is a graph indicating a toner adhesion amount at each position along the sheet-passing direction.

Data as shown in FIG. 4 can be obtained, for example, by putting together the toner adhesion amounts at the respective positions in the sheet-passing direction. The data of FIG. 4 are based on an image with a coverage of 80% in which the total amount of adhering toner of all the colors (Y, M, C, K) in the main scanning direction is 6.6 $g/m^2$.

Next, control section 100 obtains from development current detection section 412B an actual measurement value of a development current at each position in the sheet-passing direction. Data as shown in FIG. 5 can be obtained, for example, by putting these actual measurement values together.

Figure 5:
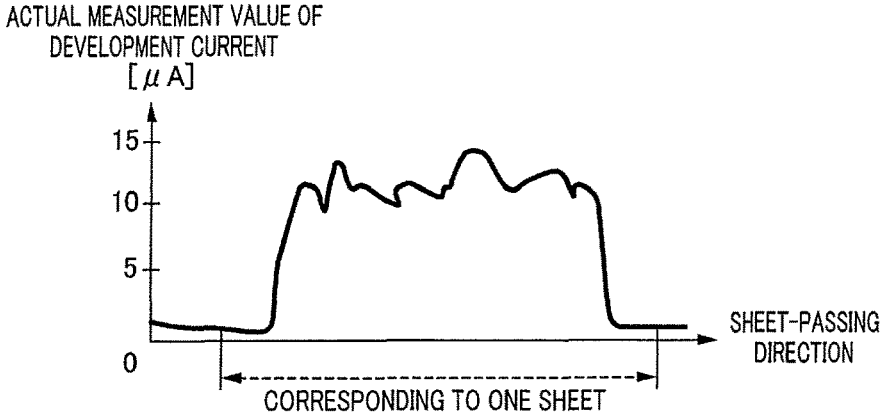
FIG. 5 is a graph indicating an actual measurement value of a development current at each position along the sheet-passing direction.
Figure 6:
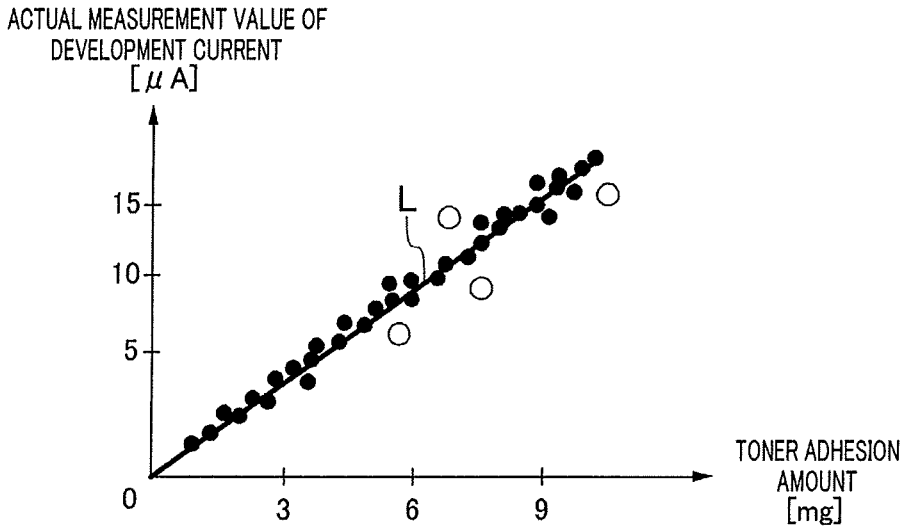
FIG. 6 is a graph of a plotted correlation between the actual measurement value of the development current and the toner adhesion amount.

A graph as illustrated in FIG. 6 can be obtained by comparing the data illustrated in FIGS. 4 and 5 and by plotting the correlation between the toner adhesion amount and the actual measurement value of the development current. Here, approximation straight line L which is a linear straight line approximating points illustrated by a black dot serves as the provisional calculation value of the development current.

In addition, points illustrated by a white dot are located at positions slightly away from approximation straight line L. In a case where an image defect occurs, the actual measurement value of the development current differs from a value of a development current supposed from the image formation conditions. Accordingly, it is supposed that the points illustrated by the white dot indicate positions at which an image defect is likely to occur.

Here, it has been known that image defects, such as swept toner, image blurring, and blanks, are likely to occur at a part corresponding to an end of an image in the sheet-passing direction. Accordingly, a possibility that the part corresponding to the end of the image in the sheet-passing direction is plotted at a position away from approximation straight line L is supposed to be high.

Accordingly, in the present embodiment, control section 100 excludes, from the calculation of the provisional calculation value of the development current, a part of the correlation between the toner adhesion amount and the actual measurement value of the development current where a possibility of the image defect occurring is supposed to be high from the image formation condition, that is, a part corresponding to the end of the image in the sheet-passing direction.

In this way, some of the points illustrated by a white dot are excluded from the calculation of the provisional calculation value of the development current, so that the provisional calculation value of the development current that is close to a development current supposed under the image formation conditions can be calculated.

Figure 7:
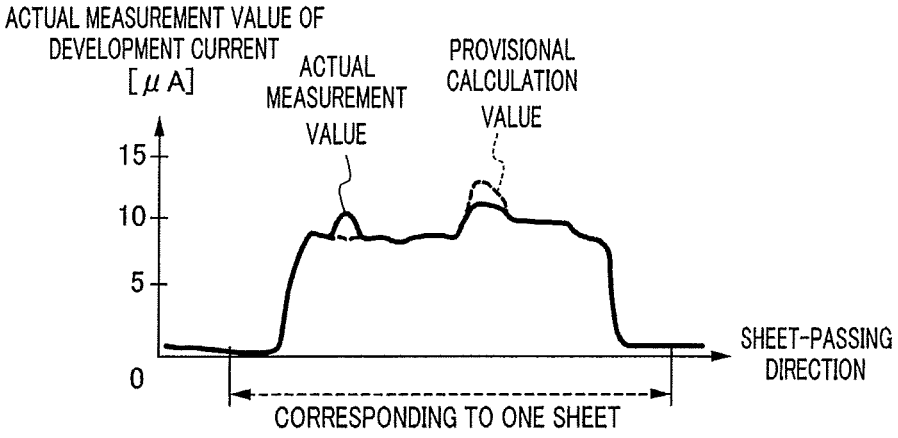
FIG. 7 is a graph for comparing the actual measurement value of the development current and the provisional calculation value of the development current at each position along the sheet-passing direction.

As illustrated in FIG. 7, when the profile of the actual measurement value of the development current and the profile of the provisional calculation value of the development current each of which corresponds to one sheet in the sheet-passing direction of sheet S are superimposed on each other, the actual measurement value of the development current is found out to be significantly different from the provisional calculation value of the development current at portions where image defects occur. A graph as illustrated in FIG. 8 can be obtained by extracting differences between the actual measurement values of the development current and the provisional calculation values of the development current.

Figure 8:
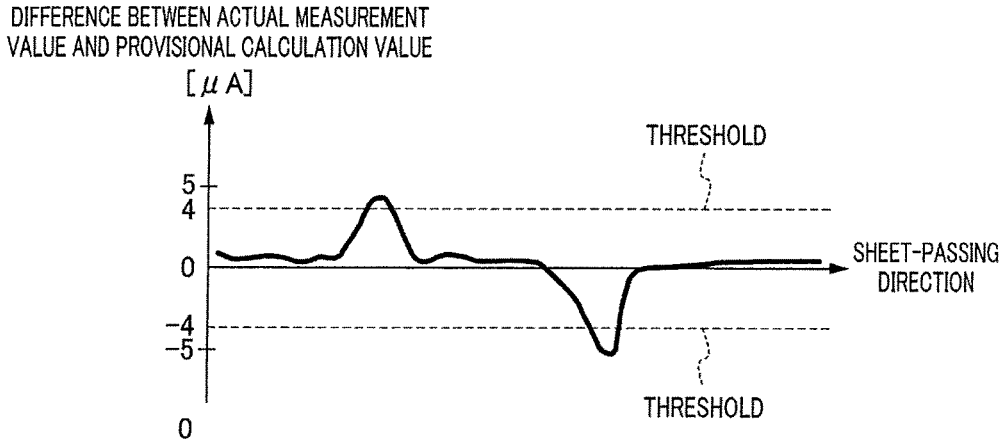
FIG. 8 is a graph indicating a difference between the actual measurement value of the development current and the provisional calculation value of the development current at each position along in the sheet-passing direction.

Here, control section 100 determines that an image defect has occurred, when an absolute value of a difference between an actual measurement value of the development current and a provisional calculation value of the development current is equal to or greater than a threshold (4 μA in FIG. 8). In this way, it is possible to easily identify the image defect as being an image defect originating from the image formation processes preceding completion of development. A method for setting a threshold is described below.

In the meantime, it is supposed, for example, that even if the absolute value of the difference between the actual measurement value of the development current and the provisional calculation value of the development current is determined to be equal to or greater than the threshold about once or twice, an actual image defect may be insignificant and no practical problem is caused. However, in a case where the difference between the actual measurement value of the development current and the provisional calculation value of the development current is determined to be equal to or greater than the threshold a predetermined number of times or more in a row at the same position in the sheet-passing direction, it is highly probable that an image defect has occurred at such a position.

Accordingly, control section 100 may be configured to determine that an image defect occurred, when the absolute value of the difference between the actual measurement value of the development current and the provisional calculation value of the development current is determined to be equal to or greater than the threshold a predetermined number of times or more in a row (for example, five consecutive times).

Figure 9:
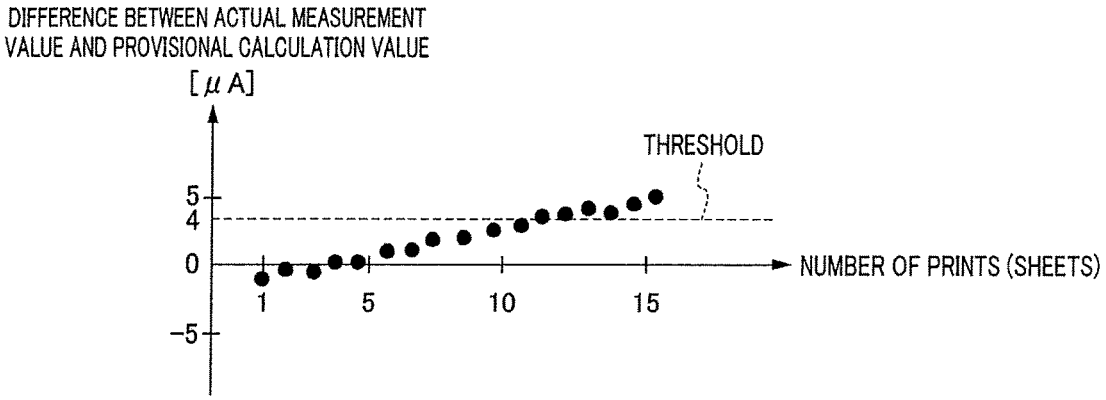
FIG. 9 is a graph indicating a change relative to the number of prints and of the difference between the actual measurement value of the development current and the provisional calculation value of the development current at each arbitrary position along the sheet-passing direction.

To be more specific, as illustrated in FIG. 9, control section 100 continuously obtains on a sheet-by-sheet basis the difference between the actual measurement value of the development current and the provisional calculation value of the development current at each position in the sheet-passing direction, and control section 100 determines that an image defect has occurred, when the absolute value of the difference is determined to be equal to or greater than the threshold a predetermined number of times or more in a row. In the example of FIG. 9, control section 100 determines that an image defect has occurred, when the number of prints comes to about 15 sheets. In this way, whether or not an image defect has occurred can be determined more certainly.

In the meantime, although the threshold is always constant in the example of FIG. 9 since the same images are consecutively printed, a threshold may be varied depending on the number of prints when different images are consecutively printed.

In addition, when the difference between the actual measurement value of the development current and the provisional calculation value of the development current is determined to be equal to or greater than the threshold, for example, control section 100 controls image forming section 40 so that an image defect does not occur. To be specific, control section 100 feeds the difference between the actual measurement value of the development current and the provisional calculation value of the development current back to image forming section 40 so as to control such that said difference does not increase to or over the threshold. In this way, occurrence of an image defect can be prevented beforehand.

The control of limiting the difference below the threshold includes, for example, control of adjusting a developing bias to be applied to developing sleeve 412A, the amount of light exposure in exposing device 411, and the charge amount in charging device 414.

In addition, control section 100 may control such that, when control section 100 has determined that the image defect has occurred, the second sheet to be ejected following the first sheet on which an image defect occurred and sheets S to be ejected following the second sheet are ejected to an ejection tray other than an ejection tray to which the first sheet was ejected. In this manner, sheet S on which the image defect occurred comes to the top of the pile of sheets on the sheet ejection tray, so that it can be easier to sort sheet S. It is to be noted that image forming apparatus 1 needs to be provided with a plurality of sheet ejection trays in order to perform the above control.

In addition, control section 100 may be configured to stop the operation of image forming apparatus 1 when control section 100 determines that an image defect has occurred.

Figure 10:
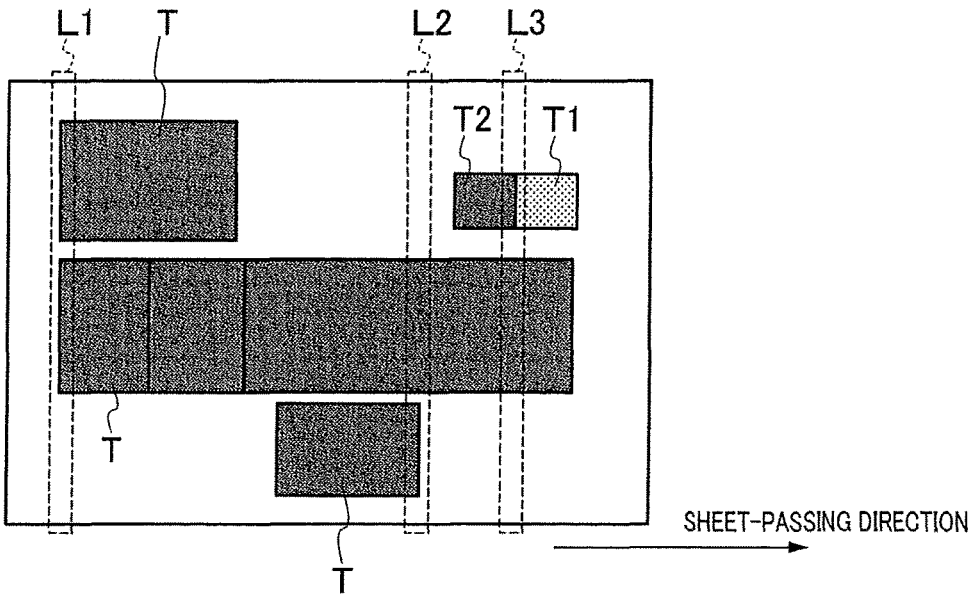
FIG. 10 is an explanatory view of a sheet on which an image has been formed, the view explaining a region in the sheet where an image defect is likely to occur.

Next, a method for setting the threshold for the difference between the actual measurement value of the development current and the provisional calculation value of the development current is described. FIG. 10 illustrates parts of a sheet on which a predetermined image has been formed and where an image defect is likely to occur.

As illustrated in FIG. 10, an image defect originating from the image formation processes preceding completion of development is likely to occur at ends of an image in the sheet-passing direction, in particular, in parts enclosed by dashed lines L1, L2, and L3.

A part enclosed by dashed line L1 is a boundary part located from a portion on which image T has been formed to a portion without image T, and corresponds to a rear end of image T in the sheet-passing direction. In such a part, swept toner is likely to occur, and the development current is likely to be greater than approximation straight line L.

A part enclosed by dashed line L2 is a boundary part located from a portion without image T to a portion on which image T has been formed, and corresponds to a front end of image T in the sheet-passing direction. In such a part, image blurring is likely to occur, and the development current is likely to be lower than approximation straight line L.

A part enclosed by dashed line L3 is a boundary part between portion T1 with a lower image density and portion T2 with a higher image density, and corresponds to both of the end of the portion with a lower image density and the end of the portion with a higher image density. In such a part, blanks are likely to occur in the portion with a lower image density, and the development current is likely to be lower than approximation straight line L.

Figure 11:
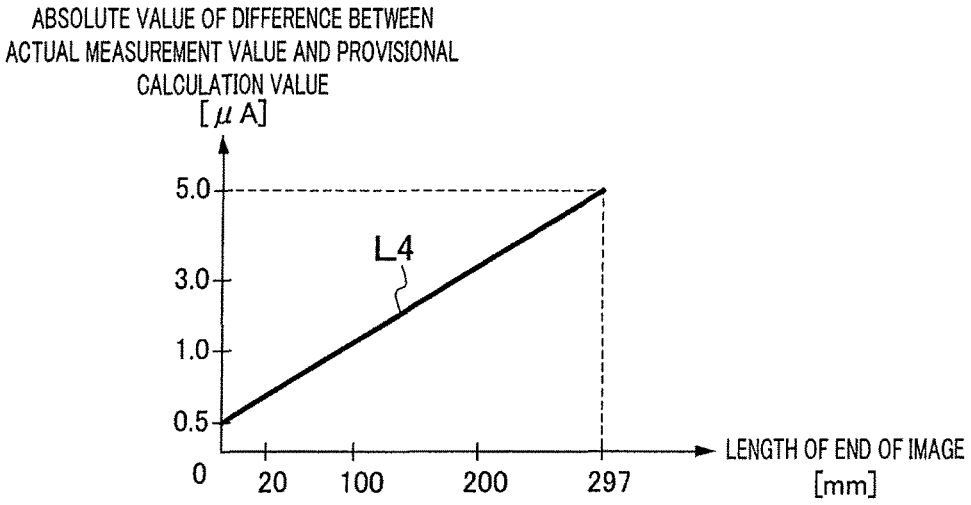
FIG. 11 is a graph indicating a threshold for the difference between the actual measurement value of the development current and the provisional calculation value of the development current to the length of an end of an image.

The frequency of occurrence of an image defect changes depending on the length of the end of the image. FIG. 11 is a graph indicating a relationship between the length of the end of the image and the threshold for the difference between the actual measurement value of the development current and the provisional calculation value of the development current. Solid line L4 illustrated in FIG. 11 indicates the threshold.

As illustrated in FIG. 11, it has been experimentally confirmed that the threshold for the difference between the actual measurement value of the development current and the provisional calculation value of the development current increases as the length of the end of the image increases. When the difference between the actual measurement value of the development current and the provisional calculation value of the development current increases to or above solid line L4, the frequency of image defect occurrence increases. It is to be noted that the length of the end of the image means a length of an image along the main scanning direction, and also the sum of lengths of ends of the image at the same position in the sheet-passing direction.

Accordingly, in the present embodiment, control section 100 set a threshold depending on the length of an end of an image. To be specific, a value on solid line L4 illustrated in FIG. 11 corresponding to the length of the end of the image is set as the threshold. In this way, a threshold corresponding to a position where an image defect is highly likely to occur can be set, so that it is possible to determine more correctly whether or not an image defect occurs.

Figure 12:
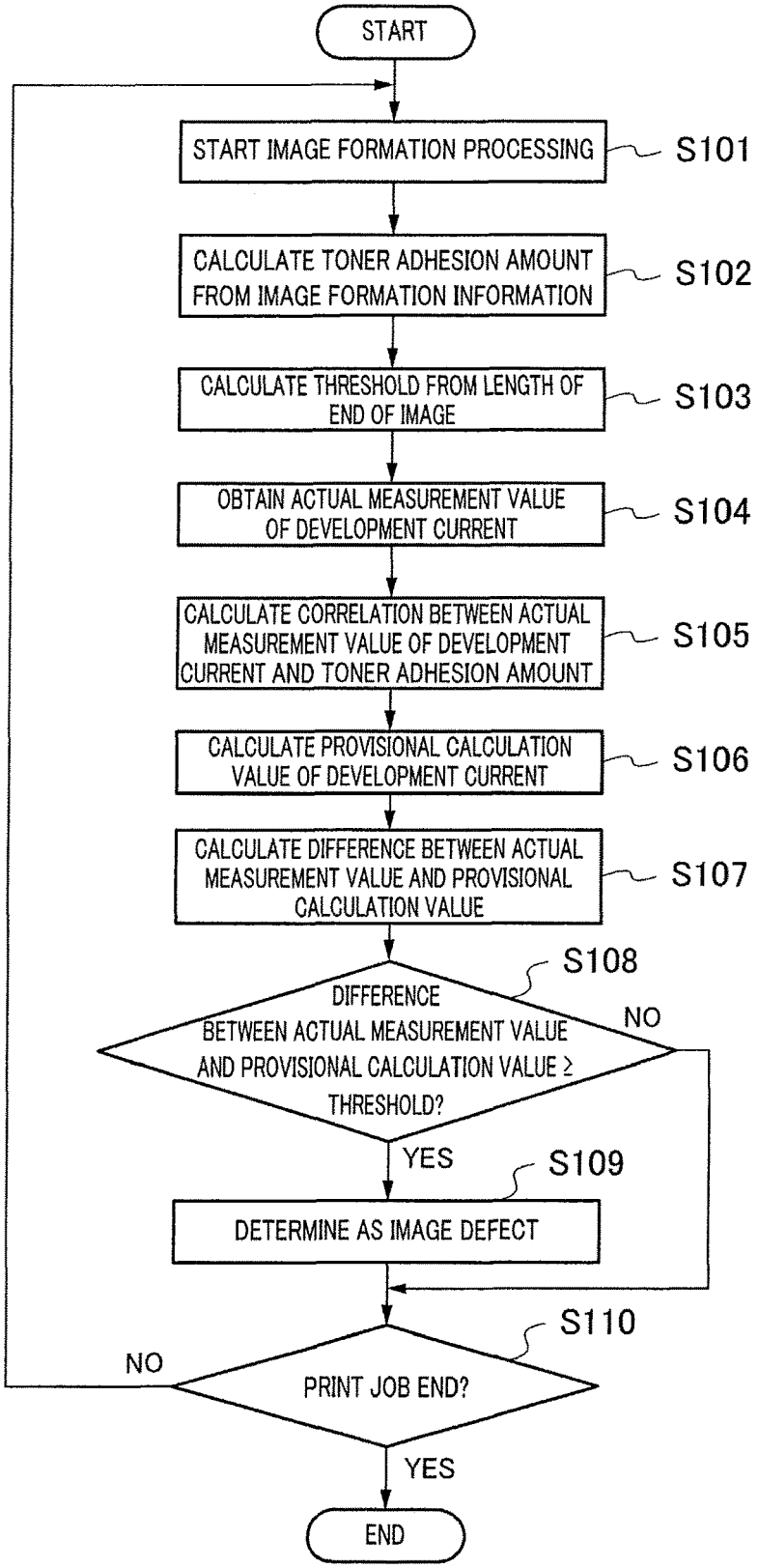
FIG. 12 is a flow chart illustrating an exemplary operation of image-defect determination control in the image forming apparatus.

Next, an exemplary operation of image-defect determination control in image forming apparatus 1 is described. FIG. 12 is a flow chart illustrating an exemplary operation of image-defect determination control in image forming apparatus 1. The processing in FIG. 12 is performed for every sheet S that is subjected to image formation processing in a printing job.

As illustrated in FIG. 12, control section 100 starts image formation processing of one sheet (step S101). Next, control section 100 calculates an amount of toner to adhere to photoconductor drum 413 from image formation information (step S102).

Next, control section 100 calculates the threshold from the length of an end of an image based on the image formation information (step S103). Next, control section 100 obtains an actual measurement value of a development current from development current detection section 412B (step S104).

Next, control section 100 calculates the correlation between the actual measurement value of the development current and the toner adhesion amount (step S105). Next, control section 100 calculates a provisional calculation value of a development current from the correlation (step S106).

Next, control section 100 calculates a difference between the actual measurement value of the development current and the provisional calculation value of the development current (step S107). Next, control section 100 determines whether or not the difference between the actual measurement value of the development current and the provisional calculation value of the development current is equal to or greater than the threshold calculated at step S103 (step S108).

When the determination result indicates that the difference between the actual measurement value of the development current and the provisional calculation value of the development current is smaller than the threshold (step S108, NO), the processing proceeds to step S110. In contrast, when the difference between the actual measurement value of the development current and the provisional calculation value of the development current is equal to or greater than the threshold (step S108, YES), control section 100 determines that an image defect has occurred (step S109).

Next, control section 100 determines whether or not the printing job has been completed (step S110). When the determination result indicates that the printing job has not been completed (step S110, NO), the processing returns to step S101. In contrast, when the printing job has been completed (step S110, YES), the present control is ended.

With image forming apparatus 1 configured as described above, whether or not an image defect occurs is determined based on the actual measurement value of the development current and the provisional calculation value of the development current, so that it is possible to determine, without increasing a machinery installation area, whether or not an image defect has occurred in the image formation processes preceding completion of development. Accordingly, causes of image defect occurrence can easily be divided, and it is thus possible to provide accurate feedback to the image formation processes preceding completion of development.

In the meanwhile, although a post-processing device including an image reading device is not provided in the above-mentioned embodiment, it may also be possible to divide causes of image defect occurrence more easily by combining a determination result in the image reading device and a determination result of control in the present embodiment if the post-processing device is provided.

In addition, programs that cause control section 100 (computer) in image forming apparatus 1 to carry out each process in the above-mentioned embodiment are also applicable to an external device, such as a printer driver and the like suitable, for example, for computers (personal computers) and/or image forming apparatus.

In addition, the aforementioned embodiments merely describe examples of implementations for practicing the present invention, and should not be construed as limiting the technical scope of the present invention. That is, the present invention can be embodied in various forms without departing from the spirit, scope, or principal features of the present invention.

The present invention is applicable to the image forming system composed of a plurality of units including an image forming apparatus. A plurality of units includes external apparatus, such as a post-processing apparatus, a control apparatus connected through a network, and the like.

Although embodiments of the present invention have been described and illustrated in detail, it is clearly understood that the same is by way of illustration and example only and not limitation, the scope of the present invention should be interpreted by terms of the appended claims.

What is claimed is:

1. An image forming apparatus comprising:

a developer bearing member that bears developer;

an image bearing member to which toner is supplied from the developer bearing member;

a development current detector that detects an actual measurement value of a development current which flows between the image bearing member and the developer bearing member;

a hardware processor that calculates a provisional calculation value of a development current based on an image formation condition, and that determines whether or not an image defect occurs, based on the actual measurement value of the development current detected by the development current detector and on the provisional calculation value of the calculated development current.

2. The image forming apparatus according to claim 1, wherein:

the hardware processor determines that the image defect has occurred, when an absolute value of a difference between the actual measurement value of the development current and the provisional calculation value of the development current is equal to or greater than a threshold.

3. The image forming apparatus according to claim 1, wherein:

the hardware processor calculates, from the image formation condition, an amount of toner to adhere to the image bearing member, and calculates the provisional calculation value of the development current based on a correlation between the calculated amount of toner and the actual measurement value of the development current detected by the development current detector.

4. The image forming apparatus according to claim 3, wherein:

the hardware processor calculates the provisional calculation value of the development current from a linear straight line approximating the correlation between the amount of toner to adhere to the image bearing member and the actual measurement value of the development current.

5. The image forming apparatus according to claim 3, wherein:

the hardware processor excludes, from the calculation of the provisional calculation value of the development current, a part of the correlation where a possibility of the image defect occurring is supposed to be high from the image formation condition.

6. The image forming apparatus according to claim 1, wherein:

the hardware processor determines that the image defect has occurred, when an absolute value of a difference between the actual measurement value of the development current and the provisional calculation value of the development current is equal to or greater than a threshold, and the hardware processor sets the threshold depending on a length of an end of an image for which determination is made as to whether or not the image defect occurs, the end being an end of the image in a sheet-passing direction, the length being a length of the end of the image along a main scanning direction orthogonal to the sheet-passing direction.

7. The image forming apparatus according to claim 6, wherein:

the hardware processor determines that the image defect has occurred, when the difference between the actual measurement value of the development current and the provisional calculation value of the development current is determined to be equal to or greater than the threshold a predetermined number of times or more in a row.

8. The image forming apparatus according to claim 1, further comprising:

an image former including the developer bearing member and the image bearing member, the image former causing toner to adhere to the image bearing member so as to form a toner image, wherein when the hardware processor determines that the image defect has occurred, the hardware processor provides the image former with feedback that the image defect has occurred, and controls the image former so that the image defect does not occur.

9. The image forming apparatus according to claim 1, further comprising:

a plurality of ejection trays to which a sheet having an image formed thereon is ejected, wherein when the hardware processor determines that the image defect has occurred, the hardware processor performs control in which a second sheet to be ejected following a first sheet on which the image defect has occurred and a sheet to be ejected following the second sheet are ejected to an ejection tray other than an ejection tray on which the first sheet is ejected.

10. The image forming apparatus according to claim 1, wherein:

the hardware processor stops an operation of the image forming apparatus when the hardware processor determines that the image defect has occurred.

11. A non-transitory recording medium storing therein a computer-readable program for an image forming apparatus including a developer bearing member that bears developer and an image bearing member to which toner is supplied from the developer bearing member, the program causing a computer in the image forming apparatus to carry out:

development-current detection processing of detecting an actual measurement value of a development current which flows between the image bearing member and the developer bearing member;

development-current calculation processing of calculating a provisional calculation value of a development current based on an image formation condition; and image-defect determination processing of determining whether or not an image defect occurs, based on the actual measurement value of the development current detected by the development-current detection processing and the provisional calculation value of the development current calculated by the development-current calculation processing.

12. The recording medium according to claim 11, wherein:

the program causes the computer in the image forming apparatus to carry out processing of determining that the image defect has occurred, when an absolute value of a difference between the actual measurement value of the development current and the provisional calculation value of the development current is equal to or greater than a threshold.

13. The recording medium according to claim 11, wherein:

the program causes the computer in the image forming apparatus to carry out processing of calculating, from the image formation condition, an amount of toner to adhere to the image bearing member, and calculating the provisional calculation value of the development current based on correlation between the calculated amount of toner and the actual measurement value of the development current.

14. The recording medium according to claim 13, wherein:

the program causes the computer in the image forming apparatus to carry out processing of calculating the provisional calculation value of the development current from a linear straight line approximating the correlation between the amount of toner to adhere to the image bearing member and the actual measurement value of the development current.

15. The recording medium according to claim 13, wherein:

the program causes the computer in the image forming apparatus to carry out processing of excluding, from the calculation of the provisional calculation value of the development current, a part of the correlation where a possibility of the image defect occurring is supposed to be high from the image formation condition.

16. The recording medium according to claim 11, wherein:

the program causes the computer in the image forming apparatus to carry out processing of determining that the image defect has occurred, when an absolute value of a difference between the actual measurement value of the development current and the provisional calculation value of the development current is equal to or greater than a threshold, and setting the threshold depending on a length of an end of an image for which determination is made as to whether or not the image defect occurs, the end being an end of the image in a sheet-passing direction, the length being a length of the end of the image along a main scanning direction orthogonal to the sheet-passing direction.

17. The recording medium according to claim 16, wherein:

the program causes the computer in the image forming apparatus to carry out processing of determining that the image defect has occurred, when the difference between the actual measurement value of the development current and the provisional calculation value of the development current is determined to be equal to or greater than the threshold a predetermined number of times or more in a row.

18. The recording medium according to claim 11, wherein:

the image forming apparatus includes an image former including the developer bearing member and the image bearing member, the image former causing toner to adhere to the image bearing member so as to form a toner image, and the program causes the computer in the image forming apparatus, when the computer determines that the image defect has occurred, to carry out processing of providing the image former with feedback that the image defect has occurred, and controlling the image former so that the image defect does not occur.

19. The recording medium according to claim 11, wherein:

the image forming apparatus includes a plurality of ejection trays to which a sheet having an image formed thereon is ejected, and the program causes the computer in the image forming apparatus, when the computer determines that the image defect has occurred, to carry out processing of performing control in which a second sheet to be ejected following a first sheet on which the image defect has occurred and a sheet to be ejected following the second sheet are ejected to an ejection tray other than an ejection tray on which the first sheet is ejected.

20. The recording medium according to claim 11, wherein:

the program causes the computer in the image forming apparatus to carry out processing of stopping an operation of the image forming apparatus when the computer determines that the image defect has occurred.

* * * * *